US006768274B2

(12) United States Patent
Konopka et al.

(10) Patent No.: US 6,768,274 B2
(45) Date of Patent: Jul. 27, 2004

(54) BALLAST WITH LAMP-TO-EARTH-GROUND FAULT PROTECTION CIRCUIT

(75) Inventors: John G. Konopka, Deer Park, IL (US); Sameer Sodhi, Vernon Hills, IL (US)

(73) Assignee: Osram Sylvania, Inc., Danvers, MA (US)

( * ) Notice: Subject to any disclaimer, the term of this patent is extended or adjusted under 35 U.S.C. 154(b) by 0 days.

(21) Appl. No.: 10/256,547

(22) Filed: Sep. 28, 2002

(65) Prior Publication Data

US 2004/0061453 A1 Apr. 1, 2004

(51) Int. Cl.[7] ..... G05F 1/00

(52) U.S. Cl. ..... 315/291; 315/307; 315/209 R; 315/282; 315/312

(58) Field of Search ..... 315/291, 307, 315/224, 46, 64, 49, 66, 74, 119, 209 R, 213, 246, 274, 278, 279, 282, 312, 324, 219; 361/42, 59, 35, 38, 71, 75, 93, 94

(56) References Cited

U.S. PATENT DOCUMENTS 5,770,925 A * 6/1998 Konopka et al. ..... 315/225
5,869,935 A * 2/1999 Sodhi ..... 315/225
5,939,836 A * 8/1999 Mita et al. ..... 315/224
5,969,483 A * 10/1999 Li et al. ..... 315/225
6,291,944 B1 * 9/2001 Hesterman et al. ..... 315/224

* cited by examiner

*Primary Examiner*—Tuyet T. Vo
(74) *Attorney, Agent, or Firm*—Kenneth D. Labudda

(57) ABSTRACT

A ballast (100) includes an inverter (140,144,146) and a protection circuit that prevents excessive lamp-to-earth-ground fault current. The protection circuit includes a transformer (202,204,206,208,210) and an inverter disable circuit (300). The transformer measures a first current going out of one set of ballast output terminals (106,108) and a second current going into another set of ballast output terminals (206,208). In response to a substantial imbalance between the first current and the second current, inverter disable circuit (300) terminates inverter switching. Preferably, protection circuit further includes a restart timer circuit (400) that, following termination of inverter switching in response to a fault condition, prevents the inverter from restarting for a predetermined delay period.

12 Claims, 2 Drawing Sheets

BALLAST WITH LAMP-TO-EARTH-GROUND FAULT PROTECTION CIRCUIT

FIELD OF THE INVENTION

The present invention relates to the general subject of circuits for powering discharge lamps. More particularly, the present invention relates to a ballast with circuitry for protecting against a lamp-to-earth-ground fault condition.

BACKGROUND OF THE INVENTION

Fluorescent lamps used with electronic ballasts periodically fail and require replacement. In most cases, replacement of a failed lamp is performed while AC power is still applied to the ballast; this practice is sometimes referred to as "live relamping." Since many newer ballast designs have non-isolated outputs, the possibility exists for high frequency output current to travel from the ballast output, through the lamp, through the person replacing the lamp, to fixture ground. Because an electrical shock may be suffered under such circumstances, safety agencies such as Underwriters Laboratories now require that ballasts be tested for this condition. Thus, standards have been established for the maximum current that is allowed to flow from the ballast output through the lamp to fixture ground. For many ballasts, these standards are readily met. However, for some ballasts, such as those models which are designed to operate with higher line voltages (e.g., 277 volts) or shorter lamp lengths (e.g., 2 foot lamps), these standards can be met only by incorporating special protective circuitry in the ballast.

Some ballast manufacturers have attempted to address the problem of excessive lamp-to-earth-ground current by trying to sense the high frequency leakage current that, in the event of a fault condition, flows out of the ballast output, into the grounded fixture, and back into the ballast via the ballast ground wire that is electrically connected to the fixture during ballast installation. An example of such an approach is described in U.S. Pat. No. 5,363,018. The main problem with this type of detection circuit is that this same type of leakage current normally flows even in the absence of a fault condition, and is actually quite desirable because it aids lamp ignition. Moreover, because the voltage applied to the lamps prior to ignition is much higher than voltage applied after ignition, the magnitude of this "normal" leakage current will be many times higher during the start-up mode than during the steady-state operating mode. Because the magnitude of the normal leakage current that flows into the ballast ground during normal starting conditions can be very close to the magnitude of the undesirable leakage current that flows through the body of a person who accidentally touches the ballast output and fixture ground, the prior art circuits cannot accurately discriminate between "normal" leakage current and the leakage current that occurs due to a true fault condition.

What is needed, therefore, is a ballast with a protection circuit that is capable of more reliably detecting a lamp-to-earth-ground fault condition. A ballast with such a protection circuit would represent a significant advance over the prior art.

DETAILED DESCRIPTION OF THE PREFERRED EMBODIMENTS

Figure 1:
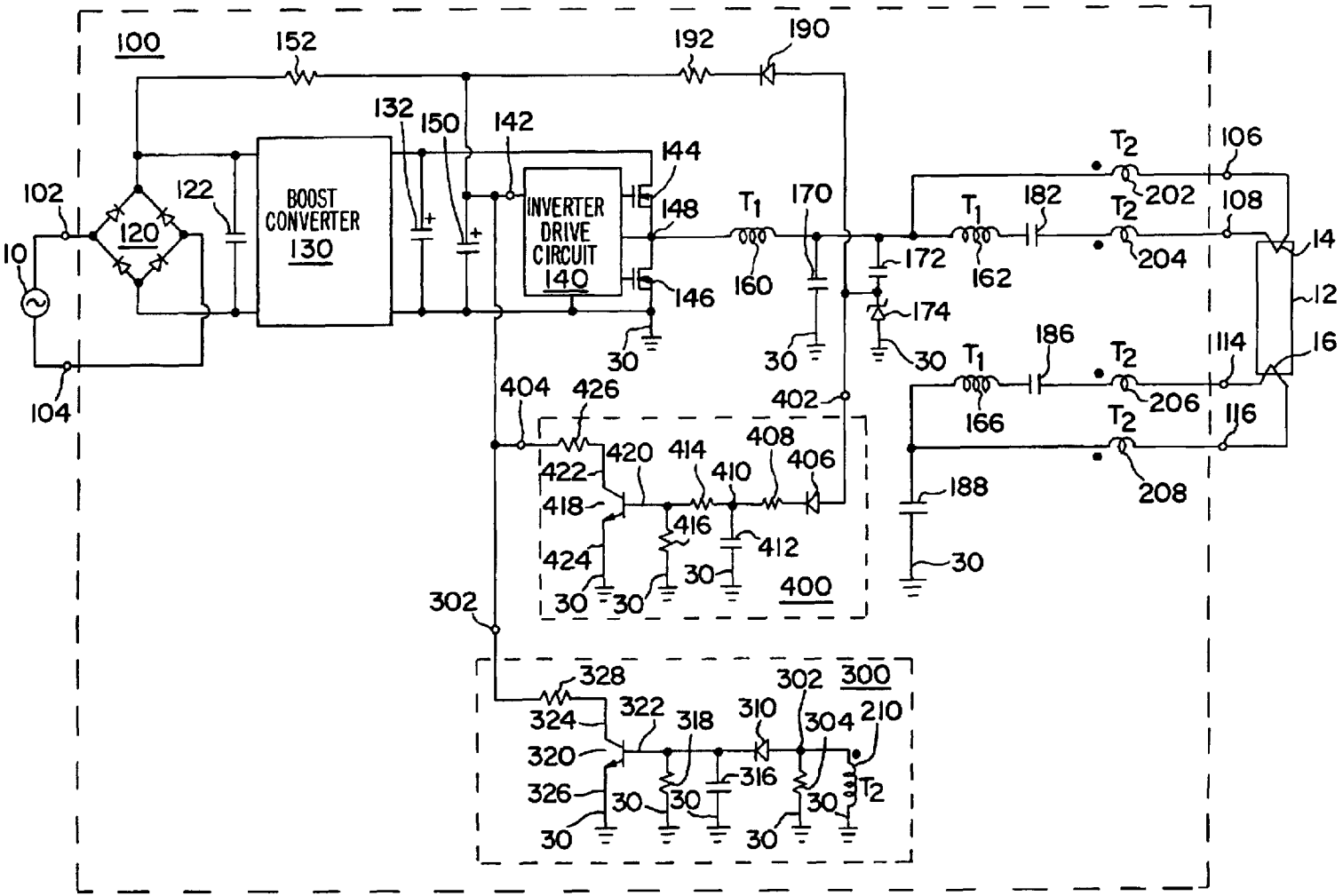
FIG. 1 describes a ballast with a lamp-to-earth-ground fault protection circuit, in accordance with a preferred embodiment of the present invention.

In a preferred embodiment of the present invention, as described in FIG. 1, a ballast 100 for powering at least one gas discharge lamp 12 includes an inverter 140,144,146,148, output connections 106,108,114,116, and a protection circuit 202,204,206,116,210,300,400. Preferably, ballast 100 further includes a pair of input connections 102,104 adapted to receive a conventional source of alternating current (e.g., 120 VAC at 60 Hertz), a full-wave diode bridge rectifier 120, a high frequency bypass capacitor 122, a boost converter 130, and a bulk capacitance 132.

The inverter is preferably implemented as a driven half-bridge 140,144,146,148. In combination with a direct-coupled series resonant output circuit 160,170, the inverter supplies a high frequency (e.g., greater than 20 kilohertz) alternating current to gas discharge lamp 12 via first, second, third, and fourth output connections 106,108,114,116. The inverter includes an inverter drive circuit 140 having a voltage supply input 142 for receiving a direct current (DC) supply voltage. Upon initial application of AC power to ballast 100, capacitor 150 charges up via resistor 152. Once the voltage across capacitor 150 reaches a predetermined startup threshold (e.g., 10 volts), inverter drive circuit 140 starts and begins to switch inverter transistors 144,146 on and off in a substantially complementary manner. Inverter drive circuit 140 continues to provide inverter switching as long as the voltage at voltage supply input 142 remains greater than a predetermined shutdown threshold (e.g., 8 volts), but will cease to provide inverter switching if the voltage at voltage supply input 142 falls below the predetermined shutdown threshold. During normal operation, the voltage at voltage supply input 142 is maintained well above the shutdown threshold by a "bootstrapping" circuit that includes capacitor 172, zener diode 174, diode 190, and resistor 192.

First and second output connections 106,108 are adapted for connection to a first filament 14 of lamp 12, while third and fourth output connections 114,116 are adapted for connection to a second filament 16 of lamp 12.

Protection circuit 202,204,206,208,210,300,400, which is coupled to the inverter and the output connections, monitors a first current and a second current. The first current is defined as the absolute value of the difference between the current flowing out of first output connection 106 and the current flowing into second output connection 108. The second current is defined as the absolute value of the difference between the current flowing out of third output connection 114 and the current flowing into fourth output connection 116. During normal operation (i.e., when no lamp-to-earth-ground fault condition is present), the first and second currents will be substantially equal. During a fault condition, the first current will not be substantially equal to the second current. Under such a fault condition, the protection circuit will disable the inverter.

The protection circuit includes a transformer $T_2$ and an inverter disable circuit 300. Transformer $T_2$ comprises four primary windings 202,204,206,208 and a secondary winding 210. First primary winding 202 is coupled in series with first output connection 106. Second primary winding 204 is coupled in series with second output connection 108. Third primary winding 206 is coupled in series with third output connection 114. Fourth primary winding 208 is coupled in series with the fourth output connection 116. Secondary winding 210 is part of inverter disable circuit 300. Preferably, first, second, third, and fourth primary windings have the same number of wire turns (e.g., 1 turn). Secondary winding 210 has a number of wire turns (e.g., 30 turns) that is substantially greater than the number of wire turns on the primary windings. The relative orientation or polarity of the four primary windings is indicated by the dots depicted in FIG. 1.

During normal operation (i.e., when no fault condition is present), the first current is substantially equal to the second current. Correspondingly, the voltages induced in first and second primary windings 202,204 are cancelled out by the voltages induced in third and fourth primary windings 206,208. Consequently, the voltage across secondary winding 210 will be substantially zero.

During a lamp-to-earth-ground fault condition, the first current will not be substantially equal to the second current because a portion of the current flowing out of output connections 106,108 will be diverted to earth ground and, thus, will not flow back into output connections 114,116. Correspondingly, the voltages induced in first and second primary windings 202,204 will not be cancelled out by the voltages induced in third and fourth primary windings 206,208. Consequently, a nonzero voltage will appear across secondary winding 210. In this way, the voltage across secondary winding 210 indicates the presence of a lamp-to-earth-ground fault condition.

The nonzero voltage that appears across secondary winding 210 during a fault condition is detected by the other circuitry in inverter disable circuit 300 so as to shut down the inverter. More particularly, in response to a nonzero voltage across secondary winding 210 of transformer $T_2$, inverter disable circuit 300 terminates inverter switching by coupling the voltage supply input 142 of inverter drive circuit 140 to circuit ground 30.

In a preferred embodiment, as described in FIG. 1, inverter disable circuit 300 comprises the secondary winding 210 of transformer $T_2$, a disable output 302, a transistor 320, a first resistor 304, a diode 310, a capacitor 316, a second resistor 318, and a third resistor 328. Secondary winding 210 and first resistor 304 are each coupled between a first node 302 and circuit ground 30. Disable output 302 is coupled to voltage supply input 142 of inverter drive circuit 140. Transistor 320 has a base 322, a collector 324, and an emitter 326. Emitter 326 is coupled to circuit ground 30. Diode 310 is coupled between first node 302 and the base 322 of transistor 320; more specifically, diode 310 has an anode coupled to first node 302 and a cathode coupled to base 322. Capacitor 316 and resistor 318 are each coupled between base 322 and circuit ground 30. Finally, third resistor 328 is coupled between disable output 302 and emitter 324 of transistor 320.

In a prototype ballast configured substantially as shown in FIG. 1, inverter disable circuit 300 was implemented with the following component values:

Resistor 304: 100 kilohms

Diode 310: 1N4148

Capacitor 316: 22 micofarads

Resistor 318: 2.2 kilohms

Transistor 320: Q2N3904

Resistor 328: 10 ohms

As previously described, it is preferred that transformer $T_2$ be implemented with one turn on each of the four primary windings 202,204,206,208, and with thirty (30) turns on secondary winding 210.

During normal operation (i.e., when no fault condition is present), the voltage across secondary winding 210 is approximately zero. Consequently, little or no voltage is provided at the base 322 of transistor 320, so transistor 320 is off. Accordingly, in the absence of a fault condition, inverter disable circuit 300 does not affect the normal operation of inverter drive circuit 140.

If a lamp-to-earth-ground fault condition occurs, a nonzero voltage will develop across secondary winding 210. The nonzero voltage across secondary winding 210 is peak-detected by diode 310 and capacitor 316, which causes transistor 320 to turn on. With transistor 320 turned on, resistor 328 is connected between voltage supply input 142 and circuit ground 30. Because resistor 328 has a very low resistance (e.g., 10 ohms), it quickly discharges capacitor 150, in spite of the fact that appreciable current continues to be supplied to capacitor 150 from bootstrap power source 172,174 via diode 190 and resistor 192. Consequently, the voltage at voltage supply input 142 rapidly falls below the level necessary to keep inverter drive circuit 140 operating, and inverter switching ceases.

Preferably, the protection circuit further includes a restart timer circuit 400 for keeping the inverter disabled for a predetermined restart period following detection of lamp-to-earth-ground fault condition. Without restart timer circuit (400), the inverter will automatically restart after a brief delay period (e.g., on the order of 100–200 milliseconds) after being disabled by inverter disable circuit 300. In order to ensure that the average rms fault current will be well within safety requirements, it is desirable that the delay period be increased considerably (e.g., to about 1.5 seconds). Restart timer circuit 300 provides such an increased delay.

In a preferred embodiment, as described in FIG. 1, restart timer circuit 400 comprises a restart input 402, a restart output 404, a transistor 418, a series combination of a diode 406 and a resistor 408, a capacitor 412, a second resistor 414, a third resistor 416, and a fourth resistor 426. Restart input 402 is coupled to the bootstrap power source 172,174 of the inverter. Restart output 404 is coupled to voltage supply input 142 of inverter drive circuit 140. Transistor 418 has a collector 422, an emitter 424, and a base 420. Emitter 424 is coupled to circuit ground 30. The series combination of diode 406 and resistor 408 is coupled between restart input 402 and a second node 410; more specifically, diode 406 has an anode coupled to restart input 402 and a cathode coupled to resistor 408, wherein resistor 408 is coupled to second node 410. Capacitor 412 is coupled between second node 410 and circuit ground 30. Second resistor 414 is coupled between second node 410 and base 420 of transistor 418. Third resistor 416 is coupled between base 420 and circuit ground 30. Finally, fourth resistor 426 is coupled between restart output 404 and collector 422 of transistor 418.

In a prototype ballast configured substantially as shown in FIG. 1, restart timer circuit 400 was implemented with the following component values:

Diode 406: 1N4148

Resistor 408: 4.7 kilohms

Capacitor 412: 10 micofarads

Resistor 414: 100 kilohms

Resistor 416: 22 kilohms

Transistor 418: Q2N3904

Resistor 426: 3.3 kilohms

The detailed operation of restart timer circuit 400 is now described with reference to FIG. 1 as follows.

During normal operation (i.e., when no fault condition is present), capacitor 412 remains charged, via bootstrap power source 172,174 and the series combination of diode 406 and resistor 408, at a voltage of approximately 15 volts. A portion of the voltage across capacitor 412 is applied (via resistors 414,416) to transistor 418, which turns on and connects restart output 404 (and thus voltage supply input 142 of inverter drive circuit 140) to circuit ground 30 via resistor 426. When the inverter is operating normally, the loading introduced by having voltage supply input 142 connected to circuit ground 30 via resistor 426 has no effect because resistor 426 is selected to be suitably large (e.g., 3.3 kilohms) and bootstrap power source 172,174 (which supplies operating current to inverter drive circuit 140 via diode 190 and resistor 192) is a low impedance current source that is more than capable of supplying the additional current required by the introduction of resistor 426 while the inverter is operating. Thus, during normal conditions, restart timer circuit 400 does not affect the operation of the inverter.

When inverter drive circuit 140 is shut down by inverter disable circuit 300 in response to fault condition, the connection of resistor 426 between voltage supply input 142 and circuit ground 30 will prevent drive circuit 300 from restarting for as long as the voltage across capacitor 412 is sufficient to keep transistor 418 turned on. More specifically, with resistor 426 present, capacitor 150 will be prevented from charging up (via resistor 152) to a level sufficient (e.g., 10 volts, which is the typical turn-on threshold of inverter drive circuit 140) to restart inverter drive circuit 140. With inverter drive circuit 140 disabled, bootstrap power source 172,174 no longer supplies current to capacitor 412, so the voltage across capacitor 412 will begin to decrease at a rate determined by the capacitance of capacitor 412 and the resistances of resistors 414,416. Once the voltage across capacitor 412 falls below a certain level (e.g., a few volts), transistor 418 will turn off and allow capacitor 150 to charge up (via startup resistor 152) to a level sufficient (e.g., 10 volts) to restart inverter drive circuit 140. If a lamp-to-earth-ground fault condition is still present, inverter disable circuit 300 will promptly shut down the inverter once again, and the aforementioned cycle will repeat itself for as long as a fault condition is present.

It is preferred that capacitor 412 and resistors 414,416 be sized such that transistor 418 will remain on for about 1.5 seconds after inverter drive circuit 300 is disabled in response to a fault condition; in a prototype ballast configured substantially as shown in FIG. 1, the preferred restart delay of about 1.5 seconds was achieved with capacitor 412 set at 10 microfarads, resistor 414 set at 100 kilohms, and resistors 416 set at 22 kilohms. Although the inverter will be allowed to restart every 1.5 seconds even if an uncorrected fault condition remains present, the duty cycle (and, thus, the resulting rms value of the ground fault current) will be quite low because the inverter will be promptly shut down by inverter disable circuit 300.

Figure 2:
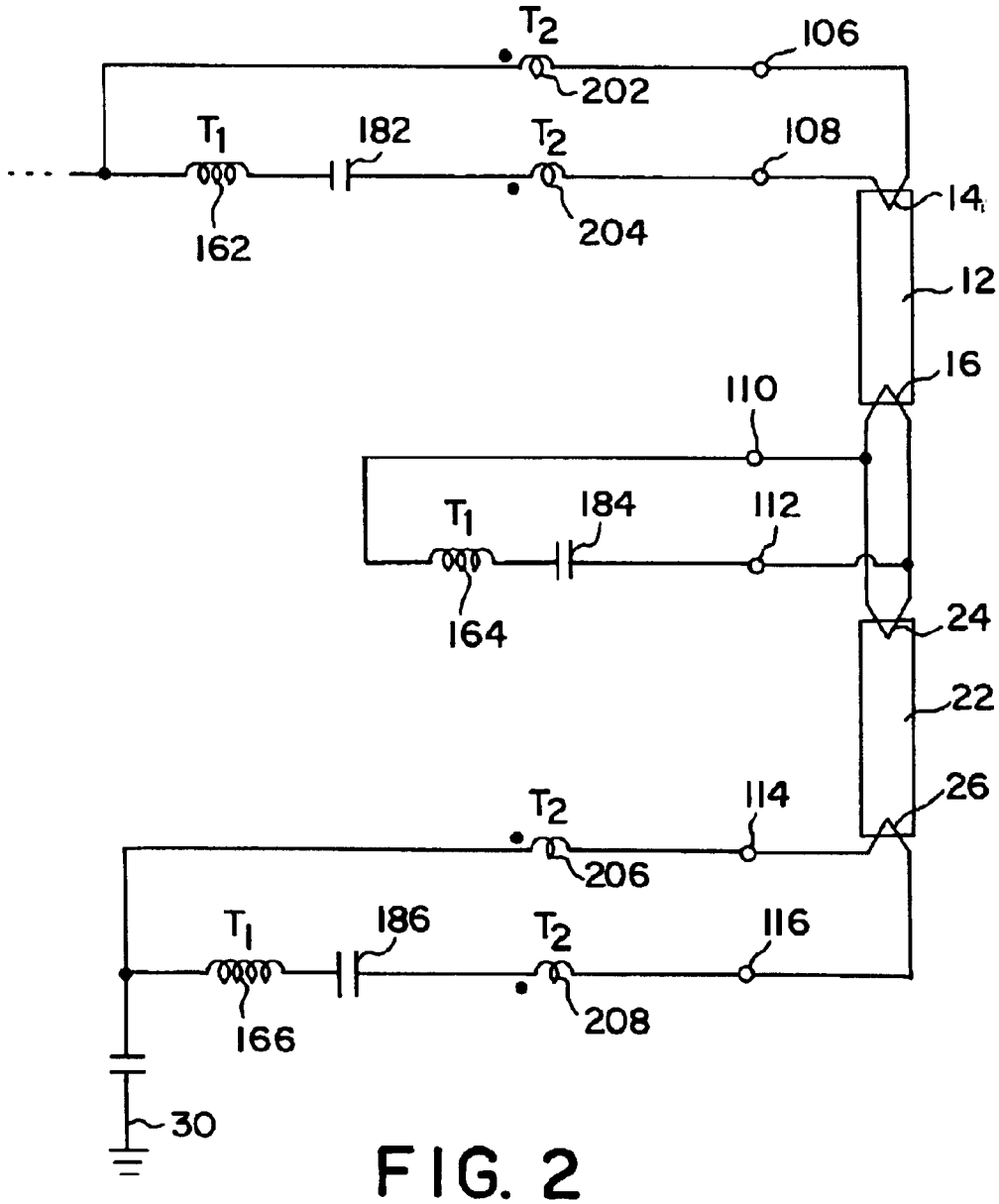
FIG. 2 describes a portion of a ballast adapted to power two gas discharge lamp, in accordance with a preferred embodiment of the present invention.

Although the ballast 100 described in FIG. 1 has been shown as operating a single lamp 12, it should be appreciated that the principles of the present invention are readily extended to a ballast that operates multiple lamps connected in series. For example, as described in FIG. 2, the circuitry detailed in FIG. 1 may be adapted to a ballast for powering two lamps 12,22 simply by adding an additional filament winding 164 (on transformer T1), an additional current-limiting capacitor 184, and additional output connections 110,112. As illustrated in FIG. 2, output connections 110,112 are coupled to both the second filament of lamp 12 and a first filament of lamp 22. Output connections 114,116 are coupled to a second filament of lamp 22. Along similar lines, ballast 100 may be further adapted to power three of four series-connected lamps. For each additional lamp, an additional filament winding, current-limiting capacitor, and pair of output connections is required.

Although the present invention has been described with reference to certain preferred embodiments, numerous modifications and variations can be made by those skilled in the art without departing from the novel spirit and scope of this invention.

What is claimed is:

1. A ballast for powering at least one gas discharge lamp, comprising;

first, second, third, and fourth output connections adapted for connection to the gas discharge lamp, wherein the first and second output connections are adapted for connection to a first filament of the lamp, and the third and fourth output connections are adapted for connection to a second filament of the lamp;

an inverter for supplying a high frequency alternating current to the gas discharge lamp, the inverter comprising:

an inverter drive circuit having a voltage supply input for receiving a supply voltage, the inverter drive circuit being operable to: (i) provide inverter switching as long as the supply voltage is greater than a predetermined shutdown voltage; and (ii) cease to provide inverter switching when the supply voltage falls below the predetermined shutdown voltage; and a bootstrap power source that is operable, while inverter switching is occurring, to provide power to the inverter drive circuit; and a protection circuit, comprising:

a transformer, comprising:

a first primary winding coupled in series with the first output connection;

a second primary winding coupled in series with the second output connection;

a third primary winding coupled in series with the third output connection;

a fourth primary winding coupled in series with the fourth output connection; and a secondary winding;

an inverter disable circuit, comprising:

a disable output coupled to the voltage supply input of the inverter drive circuit;

a transistor having a base, a collector, and an emitter, wherein the emitter is coupled to circuit ground;

the secondary winding of the transformer, the secondary winding being coupled between a first node and circuit ground;

a first resistor coupled between the first node and circuit ground;

a diode coupled between the first node and the base of the transistor;

a capacitor coupled between the base of the transistor and circuit ground;

a second resistor coupled between the base of the transistor and circuit ground; and a third resistor coupled between the disable output and the collector of the transistor; and a restart timer circuit, comprising:

a restart input coupled to the bootstrap power source of the inverter;

a restart output coupled to the voltage supply input of the inverter drive circuit;

a transistor having a collector, an emitter, and a base, wherein the emitter is coupled to circuit ground;

a series combination of a diode and a first resistor coupled between the restart input and a second node;

a capacitor coupled between the second node and circuit ground;

a second resistor coupled between the second node and the base of the transistor;

a third resistor coupled between the base of the transistor and circuit ground; and a fourth resistor coupled between the restart output and the collector of the transistor.

2. A ballast for powering at least one gas discharge lamp, comprising:

an inverter for supplying a high frequency alternating current to the gas discharge lamp, the inverter including an inverter drive circuit having a voltage supply input for receiving a supply voltage, the inverter drive circuit being operable to: (i) provide inverter switching as long as the supply voltage is greater than a predetermined shutdown voltage; and (ii) cease to provide inverter switching when the supply voltage falls below the predetermined shutdown voltage;

first, second, third, and fourth output connections adapted for connection to the gas discharge lamp, wherein the first and second output connections are adapted for connection to a first filament of the lamp, and the third and fourth output connections are adapted for connection to a second filament of the lamp; and a protection circuit coupled to the inverter and the first, second, third, and fourth output connections, the protection circuit comprising:

a transformer comprising:

a first primary winding coupled in series with the first output connection;

a second primary winding coupled in series with the second output connection;

a third primary winding coupled in series with the third output connection;

a fourth primary winding coupled in series with the fourth output connection; and a secondary winding operably coupled to the inverter;

an inverter disable circuit chat includes the secondary winding of the transformer and that is coupled to the voltage supply input of the inverter drive circuit, the inverter disable circuit being operable, in response to a nonzero voltage across the secondary winding of the transformer, to terminate inverter switching by coupling the voltage supply input to circuit ground; and a restart tuner circuit coupled to the inverter, the restart timer circuit being operable, following termination of inverter switching, so prevent the inverter from resuming inverter switching for at least a predetermined restart period.

3. The ballast of claim 2, wherein the inverter disable circuit comprises:

a disable output coupled to the voltage supply input of the inverter drive circuit;

a transistor having a base, a collector, and an emitter, wherein the emitter as coupled to circuit ground;

the secondary winding of the transformer, the secondary winding being coupled between a first node and circuit ground;

a first resistor coupled between the first node and circuit ground;

a diode coupled between the first node and the base of the transistor;

a capacitor coupled between the base of the transistor and circuit ground;

a second resistor coupled between the base of the transistor and circuit ground; and a third resistor coupled between the disable output and the collector of the transistor.

4. The ballast of claim 2, wherein:

the inverter further comprises a bootstrap power source that is operable, while inverter switching is occurring, to provide power to the inverter drive circuit and the restart timer circuit; and the restart timer circuit comprises:

a restart input coupled to the bootstrap power source of the inverter;

a restart output coupled to the voltage supply input of the inverter drive circuit;

a transistor having a collector, an emitter, and a base, wherein the emitter is coupled to circuit ground;

a series combination of a diode and a first resistor coupled between the restart input and a second node;

a capacitor coupled between the second node and circuit ground;

a second resistor coupled between the second node and the base of the transistor;

a third resistor coupled between the base of the transistor and circuit ground; and a fourth resistor coupled between the restart output and the collector of the transistor.

5. A ballast for powering at least one gas discharge lamp, comprising:

an inverter for supplying a high frequency alternating current to the gas discharge lamp;

first, second, third, and fourth output connections adapted for connection to the gas discharge lamp, wherein the first and second output connections are adapted for connection to a first filament of the lamp, and the third and fourth output connections are adapted for connection to a second filament of the lamp; and a protection circuit coupled to the inverter and the first, second, third, and fourth output connections, the protection circuit comprising:

a transformer, comprising:

a first primary winding coupled in series with the first output connection;

a second primary winding coupled in series with the second output connection;

a third primary winding coupled in series with the third output connection;

a fourth primary winding coupled in series with the fourth output connection; and a secondary winding operably coupled to the inverter, the secondary winding having a voltage that is: (i) substantially zero in the absence of a lamp-to-earth-ground fault condition; and (ii) nonzero in the presence of a lamp-to-earth-ground fault condition.

6. The ballast of claim 5, wherein the first, second, third, and fourth primary windings have the same number of wire turns.

7. The ballast of claim 6, wherein the secondary winding has a number of wire turns that is substantially greater than the number of wire turns on the first, second, third, and fourth primary windings.

8. The ballast of claim 5, wherein the protection circuit comprises a transformer having:

a first primary winding coupled in series with the first output connection;

a second primary winding coupled in series with the second output connection;

a third primary winding coupled in series with the third output connection;

a fourth primary winding coupled in series with the fourth output connection; and a secondary winding operably coupled to the inverter, the secondary winding having a voltage that is: (i) substantially zero when the first current is substantially equal to the second current; and (ii) nonzero when the first current is no; substantially equal to the second current.

9. The ballast of claim 8, wherein:

the inverter includes an inverter drive circuit having at voltage supply input for receiving a supply voltage, the inverter drive circuit being operable to: (i) provide inverter switching as long as the supply voltage is greater than a predetermined shutdown voltage; and (ii) cease to provide inverter switching when the supply voltage falls below the predetermined shutdown voltage; and the protection circuit further includes an inverter disable circuit that includes the secondary winding of the transformer and that is coupled to the voltage supply input of the inverter drive circuit, the inverter disable circuit being operable, in response to a nonzero voltage across the secondary winding of the transformer, to terminate inverter switching by coupling the voltage supply input to circuit ground.

10. The ballast of claim 9, wherein the inverter disable circuit comprises:

a disable output coupled to the voltage supply input of the inverter drive circuit;

a transistor having a base, a collector, and an emitter, wherein the emitter is coupled to circuit ground;

the secondary winding of the transformer, the secondary winding being coupled between a first node and circuit ground;

a first resistor coupled between the first node and circuit ground;

a diode coupled between the first node and the base of the transistor;

a capacitor coupled between the base of the transistor and circuit ground;

a second resistor coupled between the base of the transistor and circuit ground; and a third resistor coupled between the disable output and the collector of the transistor.

11. The ballast of claim 9, wherein the protection circuit further comprises a restart timer circuit coupled to the inverter, the restart timer circuit being operable, following termination of inverter switching, to prevent the inverter from resuming inverter switching for at least a predetermined restart period.

12. The ballast of claim 11, wherein:

the inverter further comprises a bootstrap power source that is operable, while inverter switching is occurring, to provide power to the inverter drive circuit and the restart timer circuit; and the restart timer circuit comprises:

a restart input coupled to the bootstrap power source of the inverter;

a restart output coupled to the voltage supply input of the inverter drive circuit;

a transistor having a collector, an emitter, and a base, wherein the emitter is coupled to circuit ground;

a series combination of a diode and a first resistor coupled between the restart input and a second node;

a capacitor coupled between the second node and circuit ground;

a second resistor coupled between the second node and the base of the transistor;

a third resistor coupled between the base of the transistor and circuit ground; and a fourth resistor coupled between the restart output and the collector of the transistor.

* * * * *